US012357901B2

(12) United States Patent
Boehme et al.

(10) Patent No.: US 12,357,901 B2
(45) Date of Patent: Jul. 15, 2025

(54) GLOVE

(71) Applicant: PUMA SE, Herzogenaurach (DE)

(72) Inventors: Alexander Boehme, Nuremberg (DE); Thomas Schwarz, Winkelhaid (DE); Harald Barani, Herzogenaurach (DE); Christopher Hable, Erlangen (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 18/234,674

(22) Filed: Aug. 16, 2023

(65) Prior Publication Data

US 2023/0390629 A1 Dec. 7, 2023

Related U.S. Application Data

(63) Continuation-in-part of application No. 17/370,204, filed on Jul. 8, 2021, now abandoned.

(51) Int. Cl.
*A63B 71/14* (2006.01)
*A41D 19/015* (2006.01)

(52) U.S. Cl.
CPC ..... *A63B 71/148* (2013.01); *A41D 19/01564* (2013.01)

(58) Field of Classification Search
CPC ..... A63B 71/148; A41D 19/01564; A41D 19/01523; A41D 19/01547; A41D 19/01588; A41D 2400/80; B32B 2437/02
See application file for complete search history.

(56) References Cited

U.S. PATENT DOCUMENTS

| | | | |
|---|---|---|---|
| 4,027,339 | A | 6/1977 | Brucker |
| D262,160 | S | 12/1981 | Strongwater |
| 5,727,257 | A | 3/1998 | Chen |
| 5,802,614 | A | 9/1998 | Melone, Jr. |
| D418,860 | S | 1/2000 | Shimoyama |
| D445,996 | S | 8/2001 | Kiernan |
| D452,983 | S | 1/2002 | Fujimoto |
| 6,654,964 | B1 | 12/2003 | Staihar |

(Continued)

FOREIGN PATENT DOCUMENTS

| | | | | |
|---|---|---|---|---|
| CA | 2697770 A1 * | 3/2009 | ..... | A41D 19/001 |
| DE | 202018106294 U1 * | 3/2020 | ..... | D04B 1/18 |

(Continued)

OTHER PUBLICATIONS

English machine translation of EP 2075361 A1. Via Clarivate Analytics performed on PE2E Search. Translation performed on Sep. 23, 2024. (Year: 2009).*

(Continued)

*Primary Examiner* — Jameson D Collier
(74) *Attorney, Agent, or Firm* — Quarles & Brady LLP

(57) ABSTRACT

A goalkeeper's glove for a goalkeeper includes a base knit and a plurality of finger stalls. Two or more of the finger stalls can include a compression knit area configured to be located circumjacent a proximal interphalangeal joint of fingers of a wearer. A wrist collar with a compression knit area can be configured to be located circumjacent the radiocarpal joint of the wearer. The compression knit areas of the finger stalls and the wrist collar can be configured to provide support to the fingers and wrist of the wearer, respectively, in a manner similar to athletic tape.

21 Claims, 9 Drawing Sheets

(56) References Cited

U.S. PATENT DOCUMENTS

| | | | |
|---|---|---|---|
| D619,305 | S | 7/2010 | Fitzgerald |
| D625,051 | S | 10/2010 | Fitzgerald |
| 8,771,820 | B1 | 7/2014 | Goodspeed |
| D750,845 | S | 3/2016 | Kawano |
| D752,296 | S | 3/2016 | Urbelis |
| D788,402 | S | 6/2017 | Votel |
| D789,030 | S | 6/2017 | Votel |
| D806,321 | S | 12/2017 | Lim |
| D866,871 | S | 11/2019 | Hong |
| D867,719 | S | 11/2019 | Harris, Jr. |
| D883,610 | S | 5/2020 | Hong |
| D890,473 | S | 7/2020 | Butts |
| D940,992 | S | 1/2022 | Harris, Jr. |
| D946,864 | S | 3/2022 | Urbelis |
| D954,390 | S | 6/2022 | Lacono |
| D963,250 | S | 9/2022 | Lacono |
| D963,988 | S | 9/2022 | Castro, Jr. |
| D967,599 | S | 10/2022 | Hu |
| D967,600 | S | 10/2022 | Hu |
| D974,002 | S | 1/2023 | Weed |
| 2002/0100104 | A1 | 8/2002 | Hochmuth |
| 2003/0154539 | A1 | 8/2003 | Lucas |
| 2007/0245455 | A1 | 10/2007 | Robba |
| 2008/0092262 | A1 | 4/2008 | James Carr |
| 2008/0263747 | A1 | 10/2008 | DeBlasis |
| 2009/0113592 | A1 | 5/2009 | Iwata |
| 2009/0139007 | A1 | 6/2009 | Bevier |
| 2009/0139010 | A1 | 6/2009 | Bevier |
| 2010/0077526 | A1 | 4/2010 | Smeltzer |
| 2010/0095428 | A1 | 4/2010 | Fisher |
| 2010/0186142 | A1 | 7/2010 | Kume |
| 2012/0030856 | A1 | 2/2012 | Bevier |
| 2012/0131725 | A1 | 5/2012 | Copeland |
| 2012/0159681 | A1 | 6/2012 | Gibby |
| 2013/0036523 | A1 | 2/2013 | Webster |
| 2013/0283864 | A1 | 10/2013 | VanErmen |
| 2014/0215685 | A1 | 8/2014 | Bush |
| 2015/0106997 | A1 | 4/2015 | Komlos |
| 2015/0119200 | A1 | 4/2015 | Jones |
| 2015/0141206 | A1 | 5/2015 | James, Jr. |
| 2015/0272243 | A1 | 10/2015 | Holdaway |
| 2016/0029721 | A1 | 2/2016 | Sheehy |
| 2016/0235140 | A1 | 8/2016 | Hoppe |
| 2016/0366958 | A1 | 12/2016 | Hochmuth |
| 2016/0375343 | A1 | 12/2016 | Woodhead |
| 2017/0295869 | A1 | 10/2017 | Choi |
| 2018/0332911 | A1 | 11/2018 | Jung |
| 2019/0091547 | A1 | 3/2019 | Schwanke |
| 2019/0150538 | A1 | 5/2019 | Champagne |
| 2019/0176014 | A1 | 6/2019 | Chen |
| 2020/0179176 | A1* | 6/2020 | Lechner ..... D04B 1/28 |
| 2021/0077891 | A1 | 3/2021 | Pechtold |
| 2021/0145093 | A1 | 5/2021 | Blunt |
| 2022/0193528 | A1 | 6/2022 | Eaton |
| 2022/0218059 | A1 | 7/2022 | Weed |
| 2022/0240610 | A1 | 8/2022 | Weed |
| 2023/0008444 | A1 | 1/2023 | Boehme |

FOREIGN PATENT DOCUMENTS

| | | | | |
|---|---|---|---|---|
| DE | 102018130930 | A1 * | 6/2020 | |
| EP | 1033154 | A1 | 9/2000 | |
| EP | 2075361 | A1 * | 7/2009 | ..... A61F 13/069 |
| GB | 2617060 | A * | 10/2023 | ..... A41D 1/005 |
| WO | 2009023026 | A1 | 2/2009 | |
| WO | WO-2018145145 | A2 * | 8/2018 | ..... A41D 19/001 |

OTHER PUBLICATIONS

English machine translation of DE 102018130930 A1. Via Clarivate Analytics performed on PE2E Search. Translation performed on Sep. 23, 2024. (Year: 2020).*

English machine translation of DE 202018106294 U1. Via Clarivate Analytics performed on PE2E Search. Translation performed on Sep. 23, 2024. (Year: 2020).*

International Search Report of International Application No. PCT/IB2022/056253, mailed Sep. 23, 2022, 3 pages.

Puma Future Grip 1 NC Goalkeeper Gloves—Amazon, Date First Available May 26, 2022, amazon.com, [online], [site visited Jan. 25, 2023], Available from internet URL https://www.amazon.com/Puma-Future-Grip-Goalkeeper-Gloves/dp/B0B29LQ14Yth=1 (Year: 2022).

Screen capture from YouTube video clip entitled "Puma Torwarthandschuhe Future Zone Grip 1 Limited—Vorabmodell des Knitted Torwarthandschuhs," 1 pg, uploaded on Apr. 5, 2022 by user "torwarttv." Retrieved from internet: https://www.youtube.com/watchv=A1K198MaHmA (Year: 2022).

Written Opinion of International Application No. PCT/IB2022/056253, mailed Sep. 23, 2022, 5 pages.

* cited by examiner

GLOVE

CROSS REFERENCE TO RELATED APPLICATIONS

This application is a continuation-in-part of U.S. patent application Ser. No. 17/370,204, filed Jul. 8, 2021, the contents of which are incorporated by reference herein in its entirety and is to be considered part of this application.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to a glove and more specifically to a glove worn by a goalkeeper (e.g., a soccer goalkeeper).

2. Description of the Background

Many gloves for goal keepers generally comprise a palm area, a wrist collar, fingers, a palm, a palm side, and a knuckle side. Conventional gloves further include some form of padding on the palm side along the palm area and the fingers. As a result, the palm side is able to absorb some of the force of a ball that is blocked or caught by the goalkeeper. Some gloves can also include a punching zone covered with a more durable material (e.g., silicone) over the metacarpophalangeal joint region of the wearer's hand to protect the wearer's knuckles when punching a soccer ball.

SUMMARY

A glove, as described herein, may have various configurations. The glove may have different knit zones and may be comprised of various materials.

In some embodiments, the present disclosure provides a glove for a goalkeeper. The glove includes a base knit and can further include a plurality of fingers, wherein two or more of the fingers can include a compression knit area configured to be located circumjacent the proximal interphalangeal joint of the fingers of a wearer. A wrist collar with a compression knit area can be configured to be located circumjacent the radiocarpal joint of a wearer. The compression knit areas of the fingers and the wrist collar can be configured to provide support to the fingers and wrist of a wearer, respectively, in a manner similar to athletic tape.

In some embodiments, the glove can include a punch zone configured to extend over the metacarpophalangeal joint and at least a portion of the metacarpals of a wearer. The punch zone can include a three-dimensional knit integrally knitted with the base knit and can be configured to provide a cushion. The punch zone can also include a grip foil extending over a substantial portion of the three-dimensional knit. In some embodiments, the grip foil can be comprised of silicone tape. In some embodiments, the grip foil can have a grip foil pattern of alternating embossed and debossed sections. In some embodiments, the grip foil pattern can be wavelike.

In some embodiments, the glove can further include a palmar section. The plurality of fingers can extend out from the palmar section and can include an index finger, a middle finger, a ring finger, a little finger, and a thumb. The palmar section can comprise latex, which can extend over at least one of the index finger, middle finger, ring finger, little finger, or thumb.

In some embodiments, the glove further comprises a first embossed area extending over the palmar section and at least one of the index finger, middle finger, ring finger, or little finger, and a second embossed area extending over the thumb, and a debossed area defining a gap between the first and second embossed areas. In some embodiments, the second embossed area can extend around the thumb to a dorsal side of the glove.

In some embodiments, the plurality of fingers can include an index finger and a thumb and the glove can further include a loose-loop knit section on a dorsal side of the glove extending across a webspace between the index finger and the thumb.

In some embodiments, the glove can further include a pull tab extending from the wrist collar.

In some embodiments, a goalkeeper's glove can include a plurality of fingers extending outward from a palmar section. Each of the fingers in the plurality of fingers can have a compression zone. The compression zones can be configured to be located circumjacent the proximal interphalangeal joint of the fingers of a wearer. In some embodiments, the compression zone in each finger of the plurality of fingers can be formed from a compression knit.

In some embodiments, the goalkeeper's glove can further include a wrist collar adjacent the palmar section. The wrist collar can be formed from a compression knit. In some embodiments, the goalkeeper's glove can further include a punch zone on a dorsal side. The punch zone can be configured to extend over the metacarpophalangeal joint and at least a portion of the metacarpals of a wearer. The punch zone can be formed with a three-dimensional knit. In some embodiments, the goalkeeper's glove can further include a grip foil extending over a substantial portion of the punch zone. The grip foil can comprise silicone tape. In some embodiments, the grip foil can include a pattern of alternating embossed and debossed sections.

In some embodiments, the goalkeeper's glove can further include a ventilation zone configured to extend over a webspace between a wearer's index finger and thumb. The ventilation zone can be formed from a loose-loop knit.

In some embodiments, the goalkeeper's glove can further include a grip zone extending over the palmar section and the plurality fingers. The grip zone can include latex. In some embodiments, the grip zone can include a debossed area and an embossed area.

In some embodiments, a goalkeeper's glove can include a plurality of zones including at least one of a compression zone, a punch zone, a ventilation zone, or a grip zone. The compression zone can include compression knit fabric. The punch zone can include three-dimensionally knit fabric, the ventilation zone comprises loose-loop knit fabric, and the grip zone comprises latex.

DETAILED DESCRIPTION OF THE DRAWINGS

Figure 1:
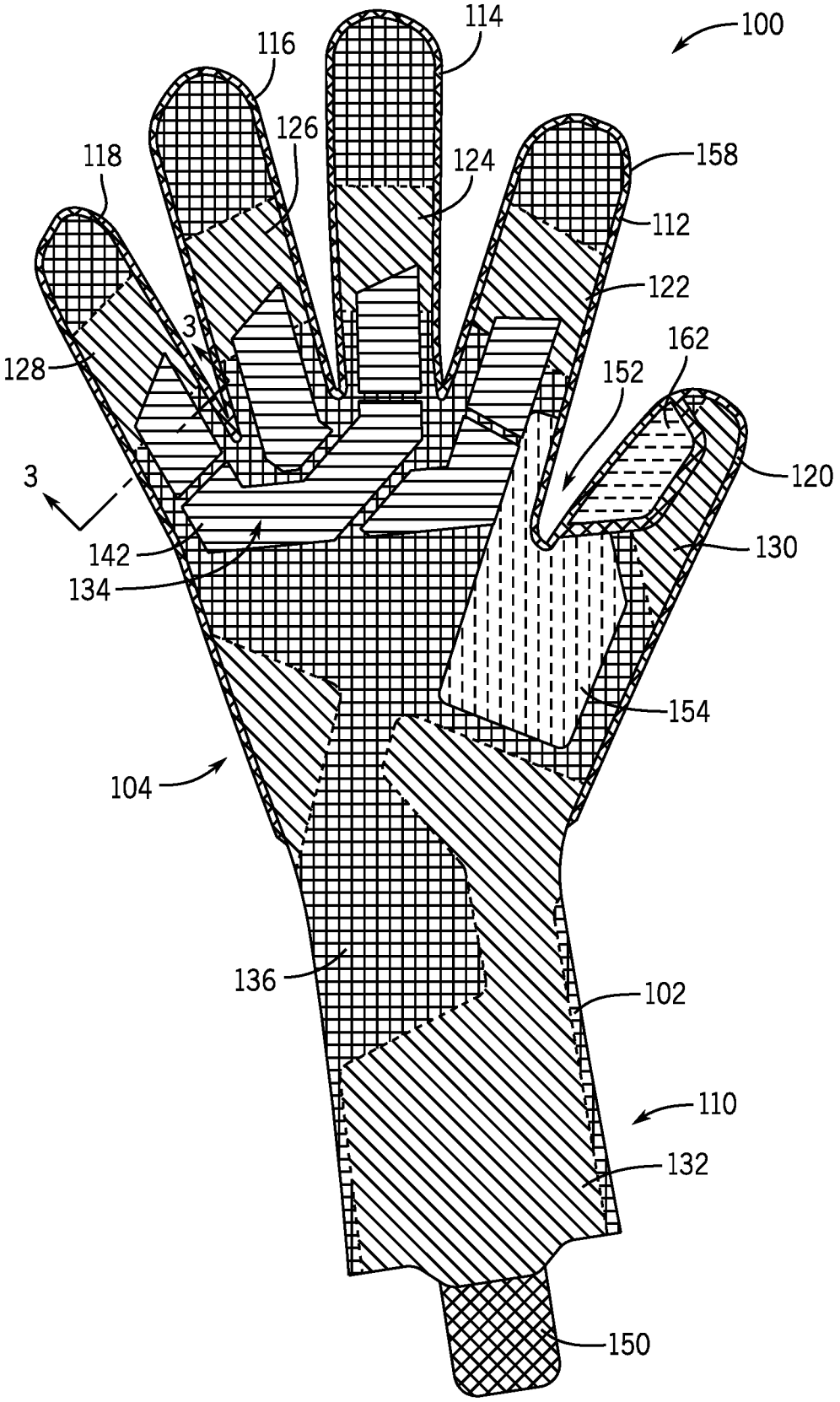
FIG. 1 is a top view of a glove configured as a left goalkeeper glove, according to an embodiment of the disclosure.

The following discussion and accompanying figures disclose various embodiments or configurations of a glove. Although embodiments of a glove are disclosed with reference to a goalkeeper's glove, concepts associated with embodiments of the glove may be applied to a wide range of glove styles, including hockey, lacrosse, kickboxing, or mixed martial arts gloves, for example. In addition to handwear, particular concepts described herein may also be applied and incorporated in other types of apparel or other athletic equipment, including helmets, padding or protective pads, and shin guards. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The terms "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent" and "wt-%."

As used herein in the context of geometric descriptions, unless otherwise limited or defined, "substantially" indicates correspondence to a particular shape or dimension within conventional manufacturing tolerances for components of a similar type or that are formed using similar processes. In this regard, for example, "substantially round" can indicate a profile that deviates from a circle to within acceptable manufacturing tolerances. Further, the term "substantial" as used herein with respect to a reference value, refers to variations from the reference value of ±15% or less (e.g., +10%, +5%, etc.), inclusive of the endpoints of the range.

Further, as used herein, unless otherwise defined or limited, directional terms are used for convenience of reference for discussion of particular figures or examples. For example, references to "downward," or other directions, or "lower" or other positions, may be used to discuss aspects of a particular example or figure, but do not necessarily require similar orientation or geometry in all installations or configurations.

The present disclosure is directed to an article of handwear (e.g., a glove) and/or specific components of the article of handwear, such as a palmar section or dorsal section. The glove may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The dorsal section may comprise a variety of materials, such as a first yarn, a second yarn, and/or a third yarn, which may have varying properties or varying visual characteristics.

Figure 2:
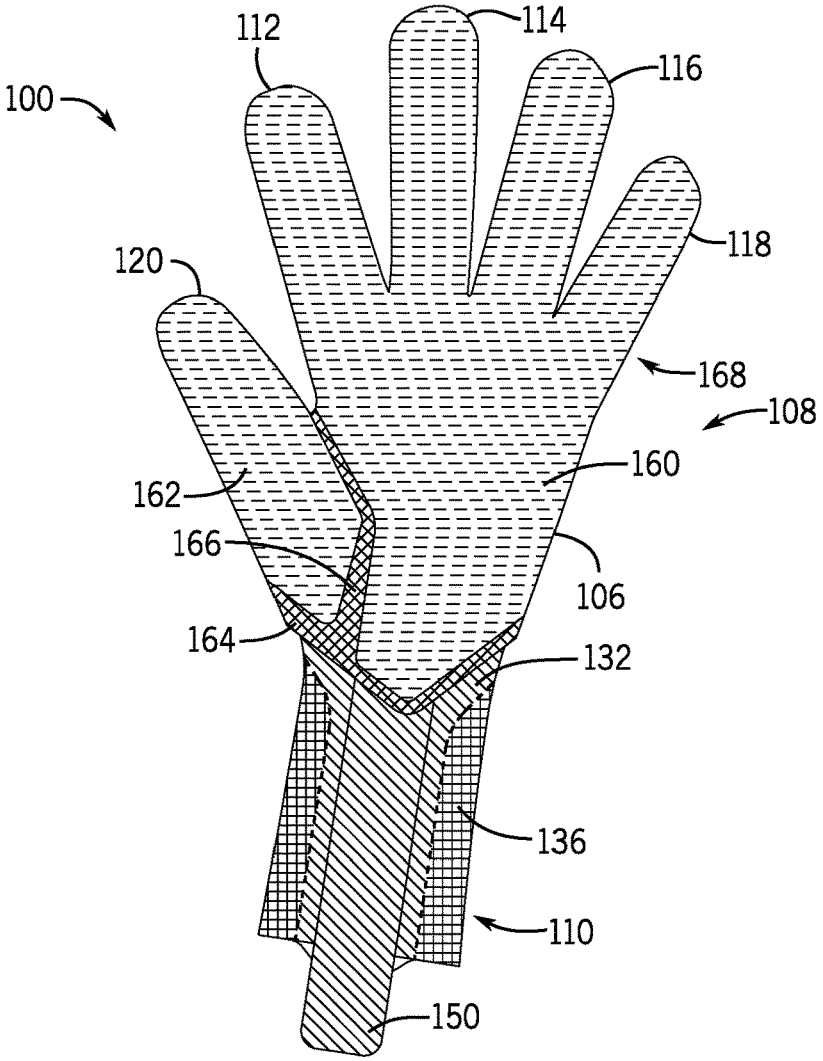
FIG. 2 is a bottom view of the glove of FIG. 1.
Figure 3:
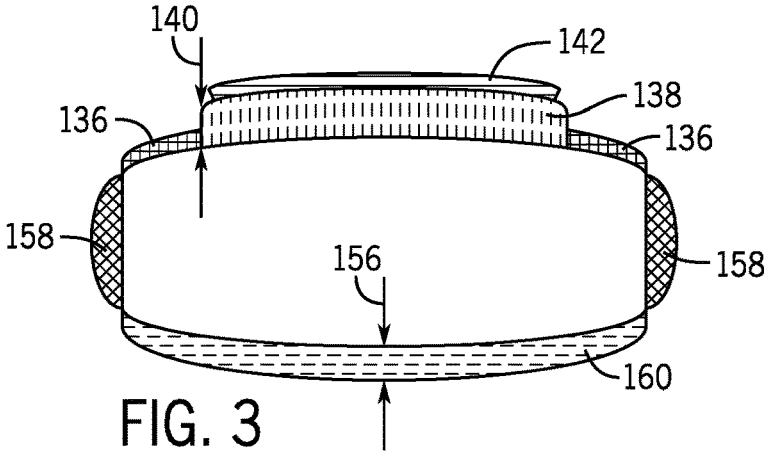
FIG. 3 is a cross-sectional view of a finger of the glove of FIG. 1 taken along line 3-3 of FIG. 1.
Figure 6:
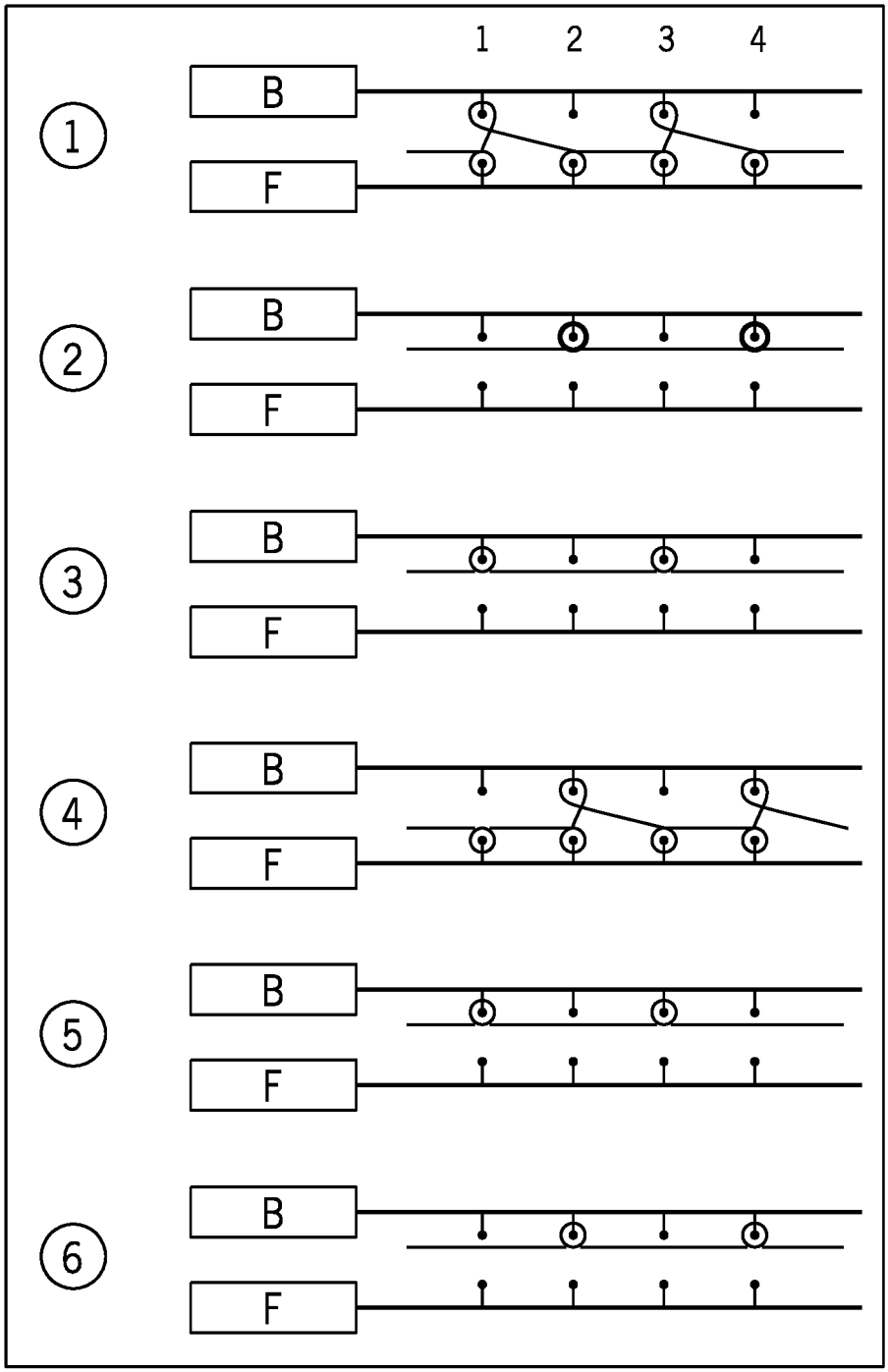
FIG. 6 is a schematic of a knitting pattern for a base knit of the glove of FIG. 1.

FIGS. 1-3 depict an embodiment of an article of handwear (i.e., a glove 100) including a dorsal section 102 on a dorsal side 104 (FIG. 1), a palmar section 106 on a palmar side 108, and a wrist collar 110. The glove 100 also includes a plurality of fingers, including an index finger 112, a middle finger 114, a ring finger 116, a little finger 118, and a thumb 120, all of which are extending from the dorsal section 102 on the dorsal side 104 and the palmar section 106 on the palmar side 108. The dorsal section 102, the wrist collar 110, and portions of the fingers 112, 114, 116, 118, 120 on the dorsal side 104 are formed primarily from a knitted textile (e.g., a regular knit to form a base knit 136). In some embodiments, the base knit 136 can be a warp knit or a weft knit formed from circular knitting. However, flat knitting the base knit 136 is also contemplated. For example, with reference to FIG. 6, a schematic of a knitting pattern for use with a V-bed knitting machine illustrates six rows of knitting used to form the knit of the base knit 136. The example V-bed knitting machine has a front needle bed (designated with the letter "F") with four needles 1 through 4 shown and a back needle bed (designated with the letter "B") with four needles 1 through 4 shown. In the first row (designated with the number "1" in a circle) yarn is fed from left to right. The yarn is looped around the number 1 needles of the front and back needle beds to form a ribbed loop, looped around the number 2 needle of the front needle bed, looped around the number 3 needles of the front and back needle beds to form a ribbed loop, and looped around the number 4 needle of the front needle bed. In the second row (designated with the number "2" in a circle) the yarn is fed from right to left. The yarn is looped around only the number 4 and number 2 needles of the back needle bed. In the third row (designated with the number "3" in a circle) the yarn is fed from left to right. The yarn is looped around only the number 1 and number 3 needles of the back needle bed. In the fourth row (designated with the number "4" in a circle) the yarn is fed from right to left. The yarn is looped around the number 4 needles of the back and front needle beds to form a ribbed loop, looped around the number 3 needle of the front needle bed, looped around the number 2 needles of the back and front needle beds to form a ribbed loop, and looped around the number 1 needle of the front needle bed. In the fifth row (designated with the number "5" in a circle) the yarn is fed from left to right. The yarn is looped around only the number 1 and number 3 needles of the back needle bed. In the sixth row (designated with the number "6" in a circle) the yarn is fed from right to left. The yarn is looped around only the number 2 and 4 needles of the back needle bed. It should be noted that variations of the disclosed knitting pattern that can produce the same or similar characteristics within the knit structure are contemplated.

Different yarns having different technical properties can also be used to form the base knit 136 to provide targeted zones of reinforcement. For example, in predetermined areas, a yarn can be knit in a manner that acts as a loose-loop knit when a lower level of force is applied (e.g., by a slow rolling ball traveling at speeds around 10-20 mph) but can also act as a tight-loop knit when a higher level of force is applied (e.g., by a hard struck ball traveling at speeds over 50 mph). It is further contemplated that in some embodiments, certain areas of the glove may be knit using holt melt thermoplastic polyurethane to create fused decorative or technical areas/zones (e.g., in areas of desired increased stiffness relative to the surrounding baseknit areas or areas in which liquid imperviousness is desired).

The palmar section 106 and the portions of the fingers 112, 114, 116, 118, 120 on the palmar side 108 are primarily formed from a material having a higher co-efficient of friction with a material of the outer cover of a ball (e.g., polyurethane (PU) as the outer cover of a soccer ball) than a knitted textile. For example, in some embodiments, the palmar section 106 and portions of the fingers 112, 114, 116, 118, 120 on the palmar side 108 can be comprised of latex. In some embodiments, the palmar section 106 portions of the fingers 112, 114, 116, 118, 120 on the palmar side 108 can be comprised of ELITE® latex, a type of latex material.

Figure 7:
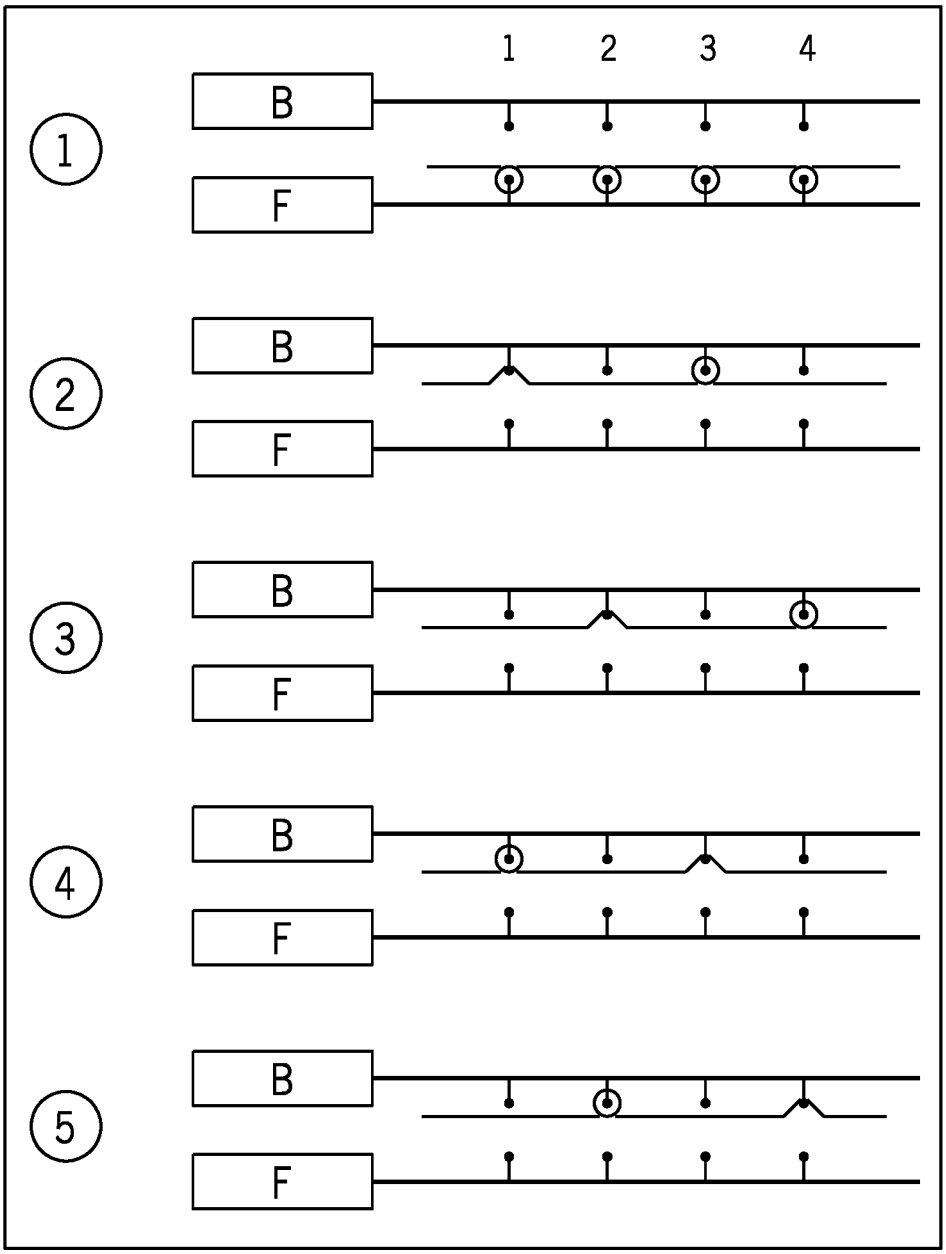
FIG. 7 is a schematic of a knitting pattern for a compression zone of the glove of FIG. 1.

Continuing to look at FIG. 1, the dorsal side 104 of the glove 100 includes a plurality of zones having different characteristics. For example, a plurality of compression zones 122, 124, 126, 128, 130, 132 are provided within the index finger 112, the middle finger 114, the ring finger 116, the little finger 118, the thumb 120, and the wrist collar 110, respectively. The compression zones 122, 124, 126, 128, 130, 132 are formed with an engineered knit that is configured to induce a compression force on the wearer. For example, looking at FIG. 7, a schematic of a knitting pattern for use with a V-bed knitting machine illustrates five rows of knitting used to form the knit of the compression zones 122, 124, 126, 128, 130, 132. The example V-bed knitting machine has a front needle bed (designated with the letter "F") with four needles 1 through 4 shown and a back needle bed (designated with the letter "B") with four needles 1 through 4 shown. In the first row (designated with the number "1" in a circle) yarn is fed from left to right. The yarn is looped around the number 1, 2, 3, and 4 needles of the front needle beds. In the second row (designated with the number "2" in a circle) the yarn is fed from right to left. The yarn is looped around the number 3 needle of the back needle bed and captured by the number 1 needle of the back needle bed for a yarn-over-knit stitch. In the third row (designated with the number "3" in a circle) the yarn is fed from left to right. The yarn is captured by the number 2 needle of the back needle bed for a yarn-over-knit stitch and looped around the number 4 needle of the back needle bed. In the fourth row (designated with the number "4" in a circle) the yarn is fed from right to left. The yarn is looped around the number 1 needle of the back needle bed and captured by the number 3 needle of the back needle bed for a yarn-over-knit stitch. In the fifth row (designated with the number "5" in a circle) the yarn is fed from left to right. The yarn is looped around the number 2 needle of the back needle bed and captured by the number 4 needle of the back needle bed for a yarn-over-knit stitch. It should be noted that variations of the disclosed knitting pattern that can produce the same or similar characteristics within the knit structure are contemplated.

Figure 5:
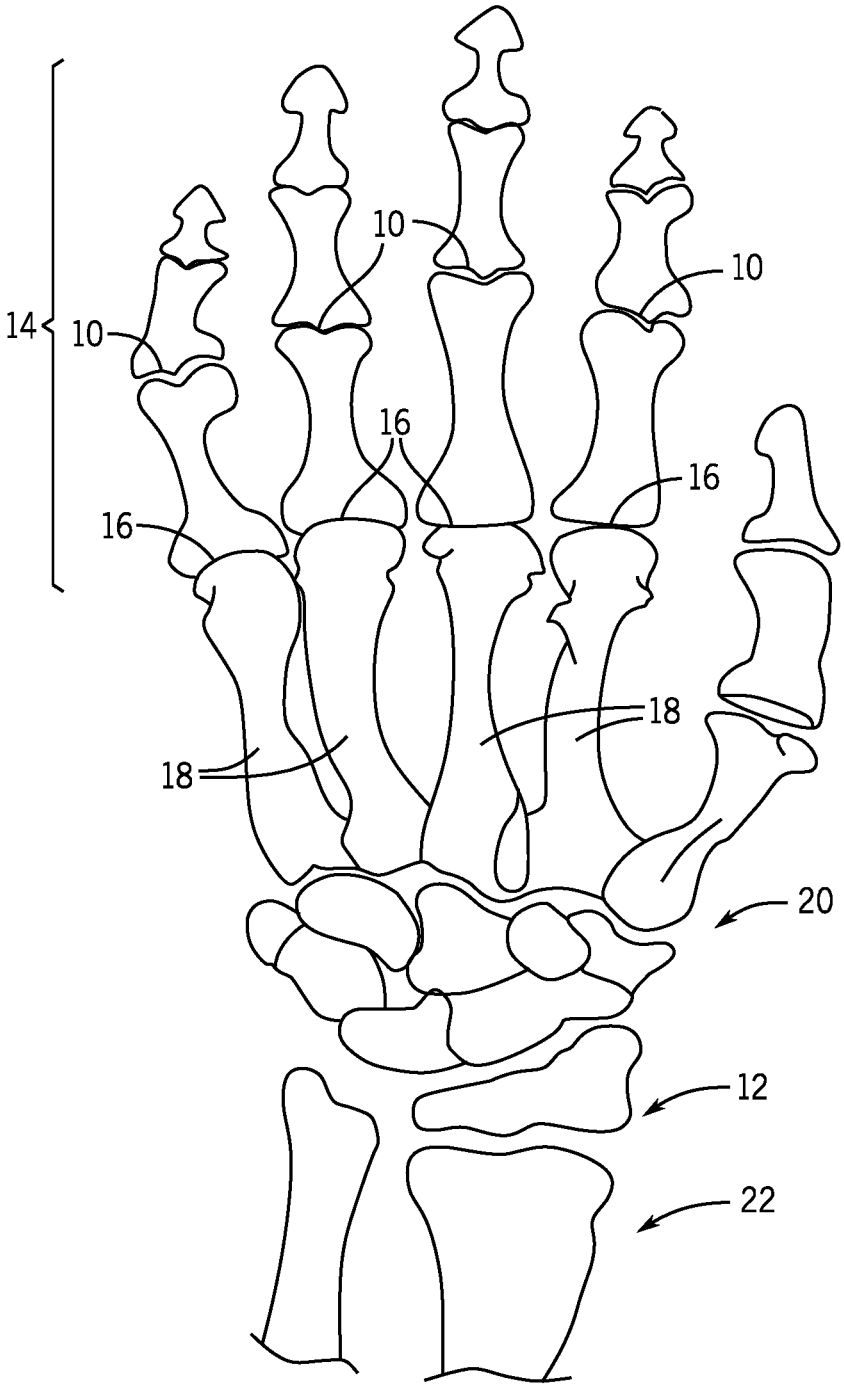
FIG. 5 is a top view of a bone structure of a human left hand.

The compression zones 122, 124, 126, 128, 130 are configured to be located circumjacent the proximal interphalangeal joint 10 of the phalanges, or fingers 14, and the compression zone 132 is configured to be located circumjacent the radiocarpal, or wrist, joint 12 of a wearer (shown in FIG. 5).

The compression zones 122, 124, 126, 128, 130, 132 are provided in areas which are common areas in which a wearer (e.g., a goalkeeper) will apply athletic tape to provide stiffening to those joints. Similarly, the compression force induced by the engineered knit in the compression zones 122, 124, 126, 128, 130, 132 can provide support to the proximal interphalangeal joints 10 and the wrist joint 12 to reduce the potential for finger deflections or dislocations of the fingers and wrist. The compression zone 132 in the wrist collar 110 is also configured to provide a snug fit around a wearer's wrist joint 12 and forearm 22 (shown in FIG. 5) to reduce the potential of the glove falling off of the wearer's hand during use and to reduce the introduction of debris or water from entering the glove 100 through the wrist collar 110.

Due to the tightness of the fit induced by the compression zones 122, 124, 126, 128, 130, 132, a pull tab 150 can be provided extending from the wrist collar 110. In some embodiments, the pull tab 150 can be attached (e.g., sewn) onto the wrist collar 110. In some embodiments, the pull tab 150 can be integrally knitted with the base knit 136. A wearer can insert one hand into the glove 100 and use the other hand to grip the pull tab 150 to aid in pulling the glove 100 over the inserted hand.

Figure 8:
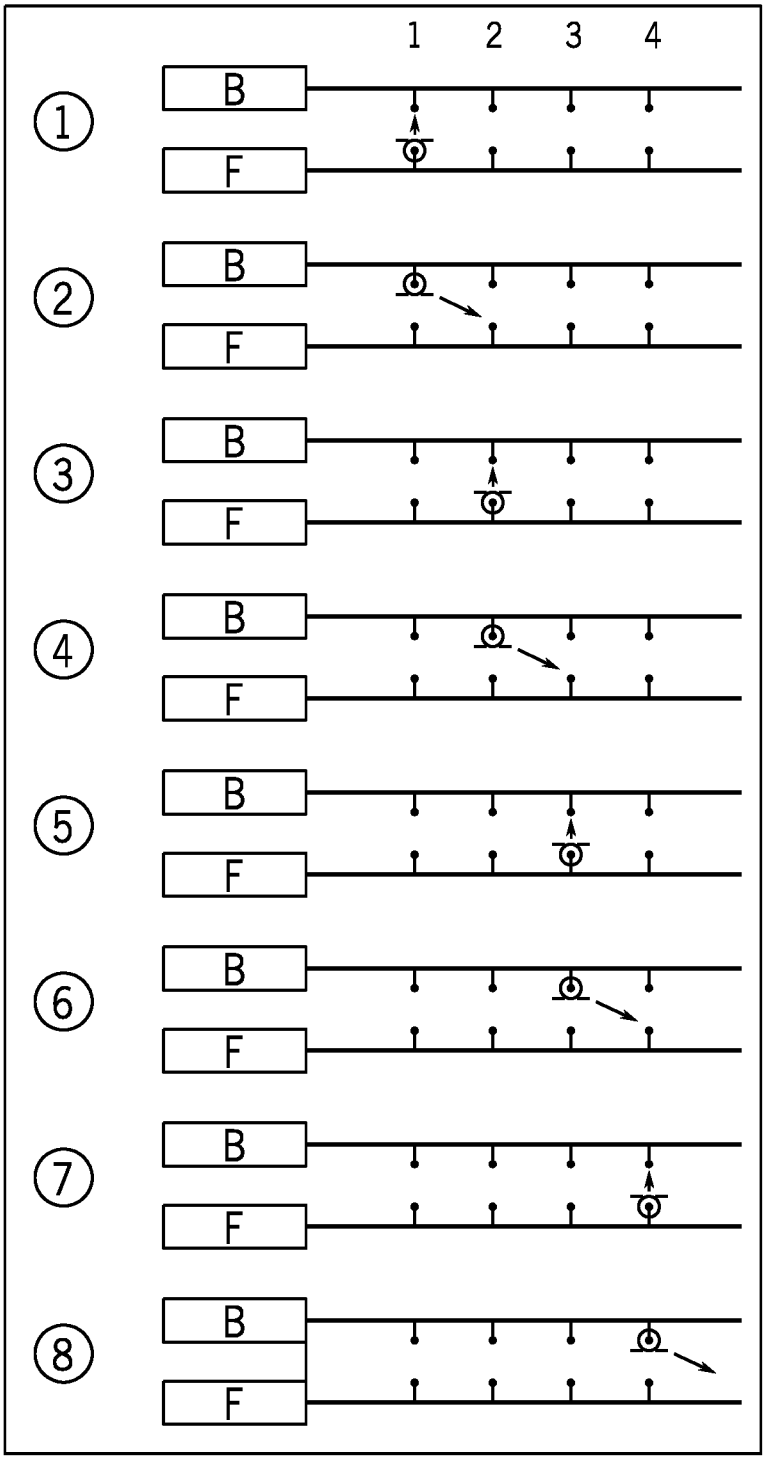
FIG. 8 is a schematic of a knitting pattern for a ventilation zone of the glove of FIG. 1.

FIG. 1 also illustrates a webspace 152 in the dorsal section 102 extending between the index finger 112 and the thumb 120. In some embodiments, a loose-loop knit can be provided in the webspace 152 to create a ventilation zone 154 on the dorsal side 104 of the glove 100. For example, with reference to FIG. 8, a schematic of a knitting pattern for use with a V-bed knitting machine illustrates eight rows of knitting used to form the loose-loop knit of the ventilation zone 154. The example V-bed knitting machine has a front needle bed (designated with the letter "F") with needles 1 through 4 shown and a back needle bed (designated with the letter "B") with four needles 1 through 4 shown. In the first row (designated with the number "1" in a circle) yarn is fed from left to right. The yarn is looped around only the number 1 needle of the front needle bed and then moved to the number 1 needle of the back needle bed. In the second row (designated with the number "2" in a circle) the yarn is fed from right to left. The yarn is looped around only the number 1 needle of the back needle bed and then moved to the number 2 needle of the front needle bed. In the third row (designated with the number "3" in a circle) the yarn is fed from left to right. The yarn is looped around only the number 2 needle of the front needle bed and then moved to the number 2 needle of the back needle bed. In the fourth row (designated with the number "4" in a circle) the yarn is fed from right to left. The yarn is looped around only the number 2 needle of the back needle bed and then moved to the number 3 needle of the front needle bed. In the fifth row (designated with the number "5" in a circle) the yarn is fed from left to right. The yarn is looped around only the number 3 needle of the front needle bed then moved to the number 3 needle of the back needle bed. In the sixth row (designated with the number "6" in a circle) the yarn is fed from right to left. The yarn is looped around only the number 3 needle of the back needle bed then moved to the number 4 needle of the front needle bed. In the seventh row (designated with the number "7" in a circle) the yarn is fed from left to right. The yarn is looped around only the number 4 needle of the front needle bed then moved to the number 4 needle of the back needle bed. In the eighth row (designated with the number "8" in a circle) the yarn is fed from right to left. The yarn is looped around only the number 4 needle of the back needle bed then moved to a number 5 needle (not shown) of the front needle bed, which turns the continuous yarn over. It should be noted that variations of the disclosed knitting pattern that can produce the same or similar characteristics within the knit structure are contemplated. The ventilation zone 154 is configured to provide ventilation for the glove 100 to keep a wearer's hand cool. The ventilation zone 154 is located in a low-contact area on the dorsal side 104 of the glove 100 in which additional padding, grip, or compression are not necessarily preferable.

Figure 9:
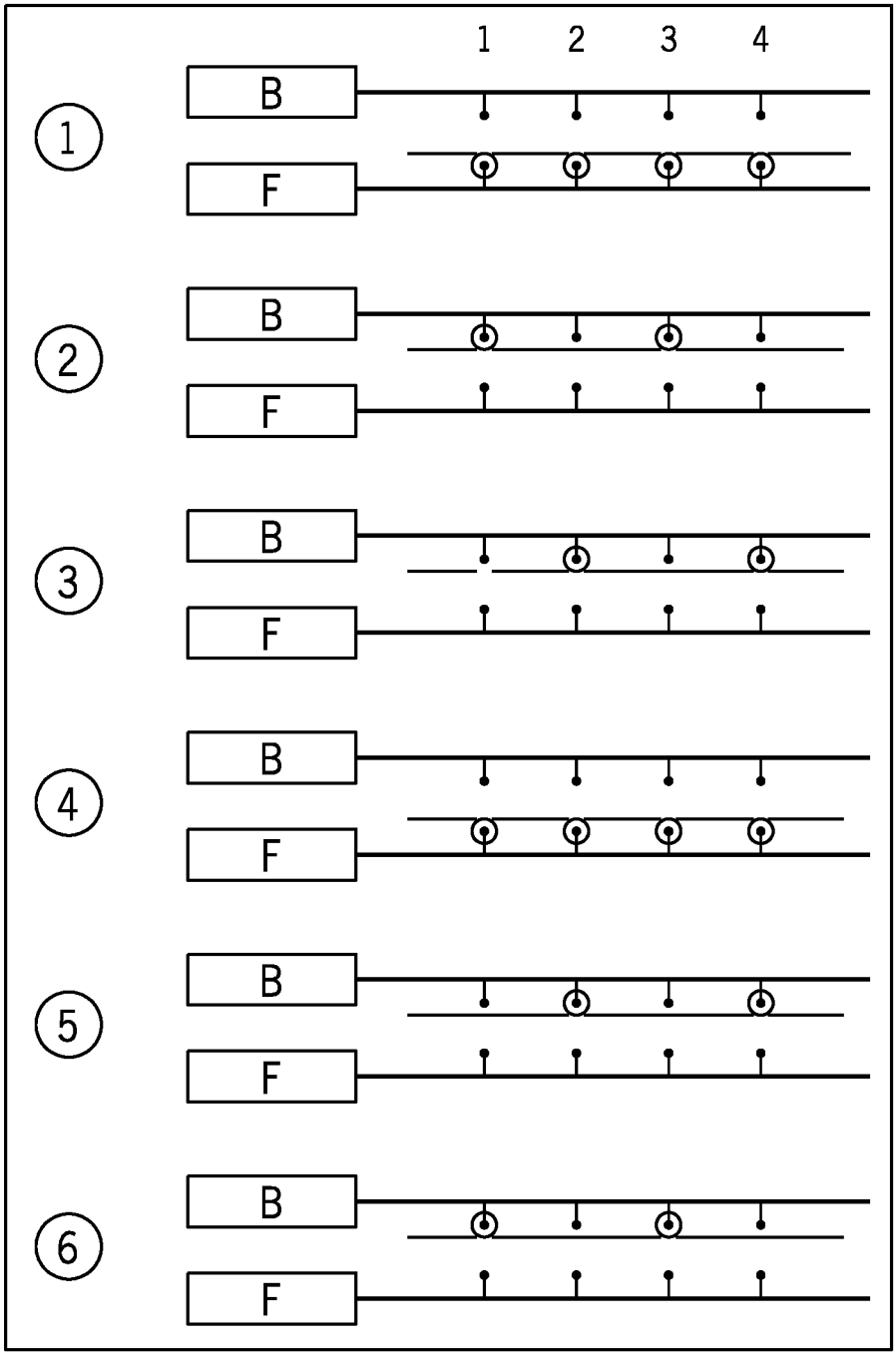
FIG. 9 is a schematic of a knitting pattern for a punch zone of the glove of FIG. 1.

FIGS. 1 and 4A-4C illustrate a punch zone 134 in the dorsal section 102. The punch zone 134 is configured to extend over the metacarpophalangeal joint 16 (shown in FIG. 5) and at least a portion of the metacarpals 18 (shown in FIG. 5) of a hand of the wearer. The punch zone 134 includes a three-dimensional knit 138 with a thickness 140 (shown in the cross-section of the little finger 118 FIG. 3) and a grip tape or foil 142 extending over a substantial portion (e.g., about 85%) of the three-dimensional knit 138. For example, with reference to FIG. 9, a schematic of a knitting pattern for use with a V-bed knitting machine illustrates six rows of knitting used to form the three-dimensional knit 138. The example V-bed knitting machine has a front needle bed (designated with the letter "F") with four needles 1 through 4 shown and a back needle bed (designated with the letter "B") with four needles 1 through 4 shown. In the first row (designated with the number "1" in a circle) yarn is fed from left to right. The yarn is looped around the number 1, 2, 3, and 4 needles of the front needle bed. In the second row (designated with the number "2" in a circle) the yarn is fed from right to left. The yarn is looped around only the number 3 and number 1 needles of the back needle bed. In the third row (designated with the number "3" in a circle) the yarn is fed from left to right. The yarn is looped around only the number 2 and number 4 needles of the back needle bed. In the fourth row (designated with the number "4" in a circle) the yarn is fed from right to left. The yarn is looped around the number 1, 2, 3, and 4 needles of the front needle bed. In the fifth row (designated with the number "5" in a circle) the yarn is fed from left to right. The yarn is looped around only the number 2 and number 4 needles of the back needle bed. In the sixth row (designated with the number "6" in a circle) the yarn is fed from right to left. The yarn is looped around only the number 3 and 1 needles of the back needle bed. It should be noted that variations of the disclosed knitting pattern that can produce the same or similar characteristics within the knit structure are contemplated.

In some embodiments, the three-dimensional knit 138 can have a thickness that varies over the punch zone 134. In other embodiments, the three-dimensional knit 138 can have a constant thickness over the punch zone 134. As shown in FIG. 3, in the cross-section of the little finger 118, the three-dimensional knit 138 has a thickness 140 that is mostly constant across the little finger 118. In some embodiments, the thickness 140 of the three-dimensional knit 138 can be about 5 mm. The three-dimensional knit 138 is integrally knitted with the base knit 136. The punch zone 134 is configured to provide a cushion to a wearer so that in instances when the wearer strikes a ball with a fist, and primarily the metacarpophalangeal joint 16 and metacarpals 18 of the hand, the force from punching the ball felt by the wearer is decreased.

Figure 4A:
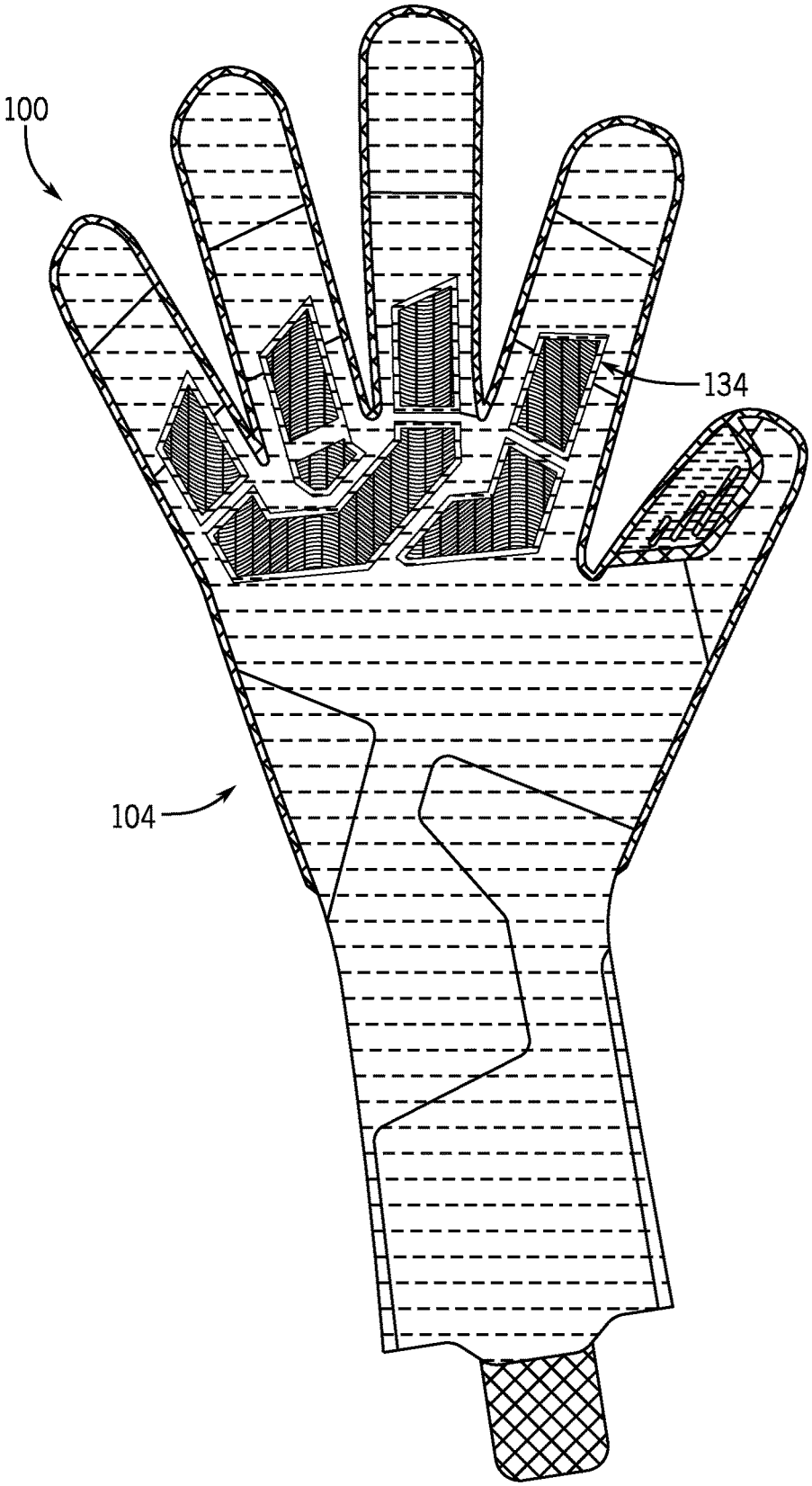
FIG. 4A is a top view of the glove of FIG. 1 illustrating embossed and debossed areas.
Figure 4B:
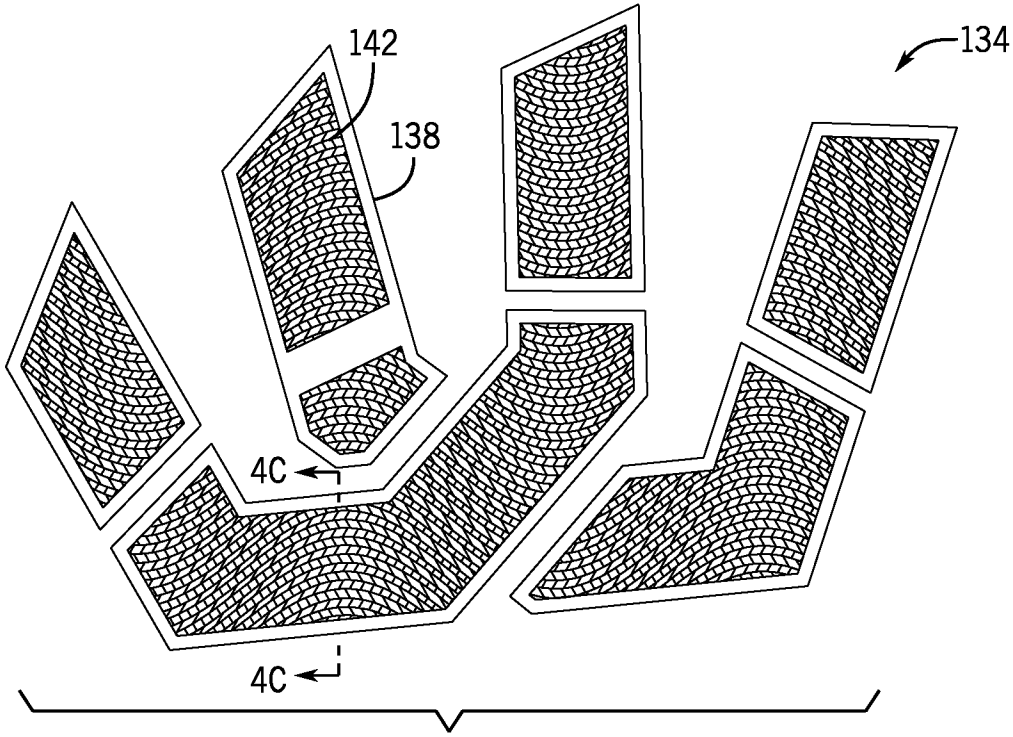
FIG. 4B is an isolated view of an embossed and debossed area on the top of the glove shown in FIG. 4A.
Figure 4C:
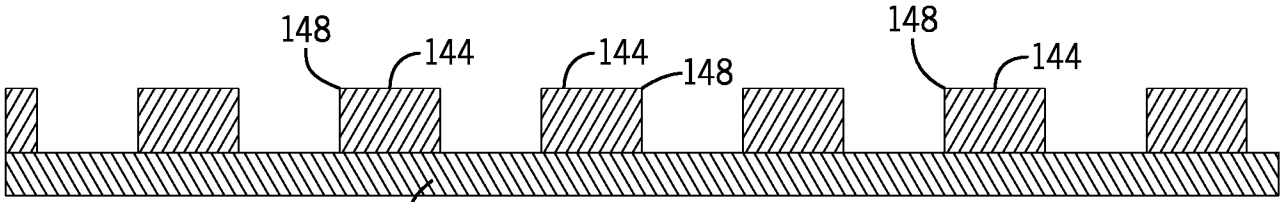
FIG. 4C is a cross-sectional view of the embossed and debossed area of the glove shown in FIG. 4A taken along line 4C-4C of FIG. 4B.

FIG. 4A illustrates the grip foil 142 on the dorsal side 104 of the glove 100 in isolation. The grip foil 142 can be provided in a pattern of alternating embossed sections 144 and debossed sections 146 of material (shown in FIG. 4B), defining edges 148 of each of the embossed sections 144 (shown in FIG. 4C). The alternating pattern of embossed and debossed sections 144, 146 can provide more controlled contact of the ball when punched due to the increased number of exposed edges 148 of the embossed sections 144. In some embodiments, the alternating pattern can be wave-like as shown in FIG. 4B. The wavelike pattern of the embossed sections 144 and the debossed sections 146 of the grip foil 142 can also provide more controlled contact of the ball because the non-singular directional pattern adds another degree of contact. For example, if all of the embossed sections extended in a singular direction, a ball could more easily glance off the punch zone 134 if the contact with the ball contacted the punch zone along the singular direction of the embossed sections and not engaging with the edges thereof. The wavelike pattern allows for many directions of contact with the embossed sections 144 in which at least some of the edges of the embossed sections 144 will be engaged when a ball is punched, and thus a more controlled contact.

In some embodiments, the grip foil 142 can be formed from silicone grip tape. The silicone can further add additional controlled contact with a punched ball due to the resilient characteristics of silicone. For example, the silicone can flex when contacted allowing the embossed sections 144 to splay to accept and engage the ball.

As shown in FIG. 3, gussets 158 can extend between the dorsal side 104 and the palmar side 108 of the glove 100 on the sides of at least one of the fingers 112, 114, 116, 118, 120 (here shown as provided along the sides of the little finger 118). The gussets 158 can be formed from latex.

Looking again at FIG. 2, the palmar side 108 of the glove 100 is shown. As stated above, the palmar section 106 and portions of the fingers 112, 114, 116, 118, 120 on the palmar side 108 can comprise a material having a higher co-efficient of friction than a knitted textile (e.g., latex) and defines a grip zone 168. In some embodiments, the material can have a thickness that varies over the palmar side 108. In other embodiments, the material can have a constant thickness over the palmar side 108. As shown in FIG. 3, in the cross-section of the little finger 118, the material has a varying thickness with a maximum thickness 156 at the center of the little finger 118. In some embodiments, the maximum thickness 156 can be about 4 mm.

Additionally, the palmar side 108 of the glove 100 has a first embossed area 160 and a second embossed area 162. The first embossed area 160 extends over the palmar section and at least one of the index finger 112, middle finger 114, ring finger 116, or little finger 118, and the second embossed 162 area extends over the thumb 120. A debossed area 164 extends between the first embossed area 160 and the second embossed area 162 from approximately the webspace 152 to the wrist collar 110 and defines a gap 166 between the first and second embossed areas 160, 162. The gap 166 provides a relief on the palmar side 108 of the glove 100 to permit easier movement of the wearer's thumb relative to the rest of the hand about the carpometacarpal joint 20 (shown in FIG. 5). In some embodiments, the debossed area 164 can extend around the lower perimeter of the palmar section 106 adjacent the wrist joint 12 (shown in FIG. 5). Similar to the gap 166, the debossed area 164 around the lower perimeter of the palmar section 106 provides a relieve, allowing for easier movement of the wearer's hand relative to a forearm 22 (shown in FIG. 5) of the wearer at the wrist joint 12. In some embodiments, the second embossed area 162 can extend around the webspace facing side of the thumb 120 and at least partially around onto the dorsal side 104 of the glove 100 (shown in FIG. 1) to provide extra padding on the inside of the wearer's thumb.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. A goalkeeper's glove defining a palmar side and a dorsal side, the goalkeeper's glove comprising:

a plurality of finger stalls that includes a first finger stall and a second finger stall, wherein, on the dorsal side, each of the first finger stall and second finger stall includes:

a first zone including a base knit;

a second zone spaced from the first zone and including the base knit, and a third zone including a compression knit that is different from the base knit and configured to provide a first compressive force to a finger of a wearer, the third zone positioned between the first zone and the second zone and configured to extend over a proximal interphalangeal joint of the finger; and wherein the glove includes a wrist collar including the compression knit, wherein the wrist collar is configured to extend over a radiocarpal joint of the wearer.

2. The goalkeeper's glove of claim 1, further comprising:

a punch zone configured to extend over a metacarpophalangeal joint and at least a portion of metacarpals of the wearer, the punch zone including a three-dimensional knit integrally knitted with the base knit to provide cushioning; and a grip foil extending over a portion of the three-dimensional knit.

3. The goalkeeper's glove of claim 2, wherein the grip foil is comprised of silicone tape.

4. The goalkeeper's glove of claim 2, wherein the grip foil comprises a grip foil pattern of alternating embossed and debossed sections.

5. The goalkeeper's glove of claim 4, wherein the grip foil pattern is wavy such that the embossed sections are a plurality of curvilinear ridges.

6. The goalkeeper's glove of claim 1, further including a palmar section;

wherein the plurality of finger stalls extend out from the palmar section and further includes a third finger stall, a fourth finger stall, and a thumb stall, wherein the palmar side comprises latex that extends from the palmar section and to at least one of the plurality of finger stalls.

7. The goalkeeper's glove of claim 6, further comprising, on the palmar side:

a first embossed area that extends along the palmar section and along at least one of the first finger stall, the second finger stall, the third finger stall, or the fourth finger stall, a second embossed area extends along the thumb stall, and a debossed area defines a gap between the first and second embossed areas.

8. The goalkeeper's glove of claim 7, wherein the second embossed area extends around the thumb stall from the palmar side to the dorsal side.

9. The goalkeeper's glove of claim 1, wherein the plurality of finger stalls further includes an index finger stall and a thumb stall, and wherein, on the dorsal side, a loose-loop knit section extends across the dorsal side between the first finger stall and the thumb stall.

10. The goalkeeper's glove of claim 1, further comprising:

a palmar section from which the first finger stall and the second finger stall extend; and a pull tab extending outward from the wrist collar in a direction away from the palmar section and opposite the first and second finger stalls.

11. A goalkeeper's glove having a palmar side and a dorsal side, the goalkeeper's glove comprising:

a palmar section;

a dorsal section opposite the palmar section; and a plurality of finger stalls extending outward from the palmar section and the dorsal section, wherein, on the dorsal side, each finger stall of the plurality of finger stalls includes:

a compression zone formed from a first knit pattern and configured to be located circumjacent a proximal interphalangeal joint of a wearer, a base zone formed from a second knit pattern, wherein the first knit pattern and the second knit pattern are configured to exhibit a different level of compression from one another, the base zone extending from the compression zone and into the dorsal section, and a punch zone formed from a three-dimensional knit pattern that is different from and integrally knit with the second knit pattern so that the three-dimensional knit pattern defines an entire thickness of a fabric layer on the dorsal side of the goalkeeper's glove within the punch zone, such that the three-dimensional knit pattern defines both an interior surface and at least a portion of an exterior surface of the goalkeeper's glove within the punch zone, wherein the interior surface is configured to contact the wearer's finger.

12. The goalkeeper's glove of claim 11, wherein the first knit pattern is a compression knit configured to provide increased local stiffness.

13. The goalkeeper's glove of claim 11, further comprising a wrist collar adjacent the palmar section, the wrist collar formed from a compression knit.

14. The goalkeeper's glove of claim 13, wherein the punch zone is configured to extend over a metacarpophalangeal joint and at least a portion of metacarpals of the wearer.

15. The goalkeeper's glove of claim 14, further comprising a grip foil extending over a portion of the punch zone, the grip foil comprising silicone tape.

16. The goalkeeper's glove of claim 15, wherein the grip foil comprises a pattern of alternating embossed and debossed sections.

17. The goalkeeper's glove of claim 11, wherein the dorsal section includes a ventilation zone that extends between a first finger stall and a second finger stall of the plurality of finger stalls, and wherein the ventilation zone is formed from a loose-loop knit.

18. The goalkeeper's glove of claim 11, wherein the palmar section and the plurality of finger stalls define a grip zone on the palmar side, the grip zone comprising latex.

19. The goalkeeper's glove of claim 18, wherein the grip zone comprises a debossed area and an embossed area.

20. A goalkeeper's glove having a palmar side and a dorsal side, the goalkeeper's glove comprising:

a plurality of zones including:

a compression zone on the dorsal side, the compression zone including a first compression knit fabric configured to provide a compressive force and configured to extend over a proximal interphalangeal joint of a finger of a wearer, a punch zone on the dorsal side, the punch zone including a three-dimensional knit fabric that is different from and integrally knit with a base knit fabric so that the three-dimensional knit fabric defines an interior surface of the goalkeeper's glove, wherein the interior surface is configured to contact the wearer's finger, and wherein the punch zone extends from the compression zone and is configured to extend over a metacarpophalangeal joint of the wearer, a ventilation zone on the dorsal side that includes a loose-loop knit fabric, and a grip zone on the palmar side that includes latex.

21. The goalkeeper's glove of claim 20, wherein the three-dimensional knit fabric defines an entire thickness of a fabric layer within the punch zone, and the glove further comprising a grip foil coupled to an exterior surface of the three-dimensional knit fabric.

* * * * *